US006160983A

United States Patent [19]

Hoberock et al.

[11] Patent Number: 6,160,983

[45] Date of Patent: Dec. 12, 2000

[54] HEATED FUSER ROLLER

[75] Inventors: Tim M. Hoberock; Scott A. Putz; David Arellano, all of Boise; Kent S. Takeshita, Eagle, all of Id.

[73] Assignee: Hewlett-Packard Company, Palo Alto, Calif.

[21] Appl. No.: 09/082,359

[22] Filed: May 20, 1998

[51] Int. Cl.[7] ..... G03G 15/20

[52] U.S. Cl. ..... 399/330; 219/216; 399/331; 399/333

[58] Field of Search ..... 399/328, 330, 399/331, 333, 90; 219/216, 469–471; 492/46

[56] References Cited

U.S. PATENT DOCUMENTS

| | | | |
|---|---|---|---|
| Re. 35,923 | 10/1998 | Mitsuya | 399/330 |
| 4,377,336 | 3/1983 | Parks et al. | 219/216 X |
| 4,628,183 | 12/1986 | Satomura | 219/216 |
| 4,724,303 | 2/1988 | Martin et al. | 219/216 |
| 4,743,940 | 5/1988 | Nagasaka et al. | 399/330 |
| 4,791,275 | 12/1988 | Lee et al. | 219/469 |
| 5,087,946 | 2/1992 | Dalal et al. . | |
| 5,241,159 | 8/1993 | Chatteriee et al. | 219/470 |
| 5,300,996 | 4/1994 | Yokoyama et al. | 399/69 |
| 5,327,202 | 7/1994 | Nami et al. | 399/333 |
| 5,530,606 | 6/1996 | Baasch et al. | 360/104 |
| 5,659,867 | 8/1997 | Young | 399/330 |
| 5,722,025 | 2/1998 | Morigami et al. | 399/330 |

FOREIGN PATENT DOCUMENTS

| | | |
|---|---|---|
| 2-220086 | 9/1990 | Japan . |
| 4-153683 | 5/1992 | Japan . |
| 5-035137 | 2/1993 | Japan . |
| 6-175528 | 6/1994 | Japan . |
| 6-301308 | 10/1994 | Japan . |
| 10-133503 | 5/1998 | Japan . |

OTHER PUBLICATIONS

Webster's Ninth New Collegiate Dictionary, p 904, copyright 1986.

*Primary Examiner*—William J. Royer

[57] ABSTRACT

A heated fuser roller that includes an elongated roller and a series of heating wires extending axially through the roller. The heating wires are positioned near the surface of the roller. Voltage is applied from a power source to the heating wires through conductive disks mounted on each end of the roller. A conductive wiper, shoe or other suitable contact device slides along each disk to maintain the electrical connection between the disks and the power source as the roller rotates.

2 Claims, 10 Drawing Sheets

HEATED FUSER ROLLER

FIELD OF THE INVENTION

The invention relates generally to a fuser for use in an electrophotographic printing device and, more particularly, to a heated fuser roller.

BACKGROUND OF THE INVENTION

In electrophotographic printing devices, toner particles are used to form the desired image on the print medium, which is usually some type of paper. Once the toner is applied to the paper, the paper is advanced along the paper path to a fuser. In many printers, copiers and other electrophotographic printing devices, the fuser includes a heated fusing roller engaged by a mating pressure roller. As the paper passes between the rollers, toner is fused to the paper through a process of heat and pressure. A variety of different techniques have been developed to heat the fusing roller. One of the most common techniques for heating a fusing roller uses a quartz lamp placed inside the roller. The lamp is turned on to heat the fusing roller during printing. So called "instant-on" fusers were developed to reduce warm-up time, eliminate the need for standby power and improve print quality in single page or small print jobs. U.S. Pat. Nos. 5,659,867, 5,087,946, and 4,724,303 describe instant-on type fuser heaters that utilize a thin walled heated fusing roller. In the '867 patent, the heating element is a group of resistive conductors positioned on the surface of a thin walled ceramic tube. The conductors are overlaid with a glassy coating to provide a smooth exterior surface for the ceramic tube. In the '946 patent, the heating element is a conductive fiber filler material added to the plastic composition that forms the wall of the roller. In the '303 patent, the heating element is a resistance heating foil or printed circuit glued to the inside surface of the thin metal wall of the roller.

While these "instant-on" fuser heating techniques may be advantageous because the heating element is near the surface of the roller, substantial changes must be made to conventional fuser roller designs to incorporate both techniques. Hence, these techniques cannot be easily incorporated into the more common fuser roller designs. In addition, these techniques are all designed for hard walled fusing rollers, not for pressure rollers in general and not for the compliant pressure rollers used in many modern fusers.

SUMMARY OF THE INVENTION

The present invention is directed to a heated fuser roller that utilizes a series of heating wires in the outer layer of the roller. The invention was developed as a means to effectively heat the pressure roller in heated pressure fusers without requiring any major modifications or changes to the design of the fuser or the fuser rollers. The fuser roller includes an elongated roller and a plurality of heating wires extending axially through the roller. The heating wires are positioned near the surface of the roller. The heating wires may be embedded in the roller as an integrated component or the heating wires may be inserted into holes that extend axially through the rollers. In one preferred version of this embodiment of the invention, voltage is applied from a power source to the heating wires through conductive disks mounted on each end of the roller. Each heating wire runs axially through the roller between the disks. A conductive wiper, shoe or other suitable contact device slides along each disk to maintain the electrical connection between the disks and the power source as the roller rotates.

The invention may also be embodied in a fuser that includes a pressure roller and a fusing roller. The heating wires are used to heat the pressure roller, the fusing roller, or both. In one preferred version of this embodiment, the fuser includes a conventional heated fusing roller and a heated pressure roller that engages the fusing roller during fusing operations. The heating element in the fusing roller is a quartz lamp. The heating element in the pressure roller includes a series of heating wires extending axially through the pressure roller near the surface of the roller.

"Heating wire" or "heating wires" as used in this Specification and in the Claims refers generally to all types of elongated resistive conductors.

DETAILED DESCRIPTION OF THE INVENTION

Figure 1:
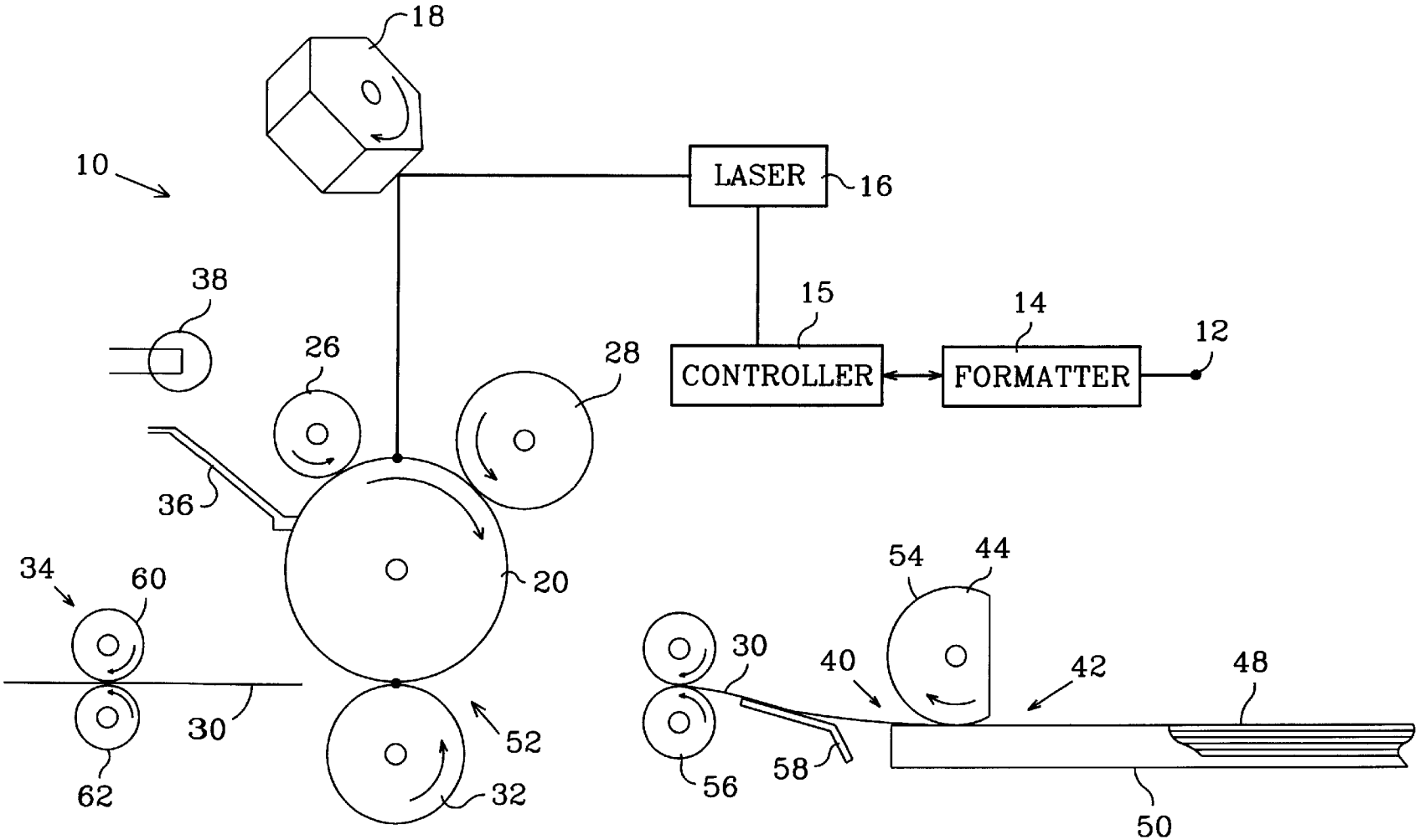
FIG. 1 is a representational elevation view of a laser printer.

FIG. 1 illustrates a laser printer, designated by reference number 10, that incorporates one embodiment of the present invention. In general, and referring to FIG. 1, a computer transmits data representing an image to input port 12 of printer 10. This data is analyzed in formatter 14. Formatter 14 includes consists of a microprocessor and related programmable memory and page buffer. Formatter 14 formulates and stores an electronic representation of each page to be printed. Once a page has been formatted, it is transmitted to the page buffer. The page buffer breaks the electronic page into a series of lines one dot wide. This line of data is sent to the printer controller 15. Controller 15, which also includes a microprocessor and programmable memory, drives laser 16 and controls the drive motor(s), fuser temperature and pressure, and the other print engine components and operating parameters.

Each line of data is used to modulate the light beam produced by laser 16. The light beam is reflected off a multifaceted spinning mirror 18. As each facet of mirror 18 spins through the light beam, it reflects or "scans" the beam across the side of a photoconductive drum 20. Photoconductive drum 20 rotates just enough that each successive scan of the light beam is recorded on drum 20 immediately after the previous scan. In this manner, each line of data is recorded on photoconductive drum 20. Toner is electrostatically transferred from developing roller 28 toner onto photoconductive drum 20 according to the data previously recorded on the drum. The toner is thereafter transferred from photoconductive drum 20 onto paper 30 as paper 30 passes between drum 20 and transfer roller 32. Drum 20 is cleaned of excess toner with cleaning blade 36. Drum 20 may be completely discharged by discharge lamps 38 before a uniform charge is restored to drum 20 by charging roller 26 in preparation for the next toner transfer.

Each sheet of paper 30 is advanced to the photoconductive drum 20 by a pick/feed mechanism 42. Pick/feed mechanism 42 includes motor driven feed roller 44 and registration rollers 56. The paper stack 48 is positioned in input tray 50 to allow sliding passage of the top sheet of paper 30 into pick/feed area 40 at the urging of feed roller 44. In operation, as feed roller 44 rotates, the frictionally adherent outer surface 54 of feed roller 44 contacts the upper surface of paper 30 and pulls it into pick/feed area 40. As the leading edge of paper 30 moves through pick/feed area 40, it is engaged between a pair of registration rollers 56. Ramp 58 helps guide paper 30 into registration rollers 56. Registration rollers 56 advance paper 30 fully into image area 52 until it is engaged between drum 20 and transfer roller 32 where toner is applied to the paper as described above. Once the toner is applied to paper 30, it is advanced along the paper path to fuser 34. Fuser 34 includes a heated fusing roller 60 and a heated pressure roller 62. As the paper passes between the rollers, toner is fused to the paper through a process of heat and pressure.

Figure 2:
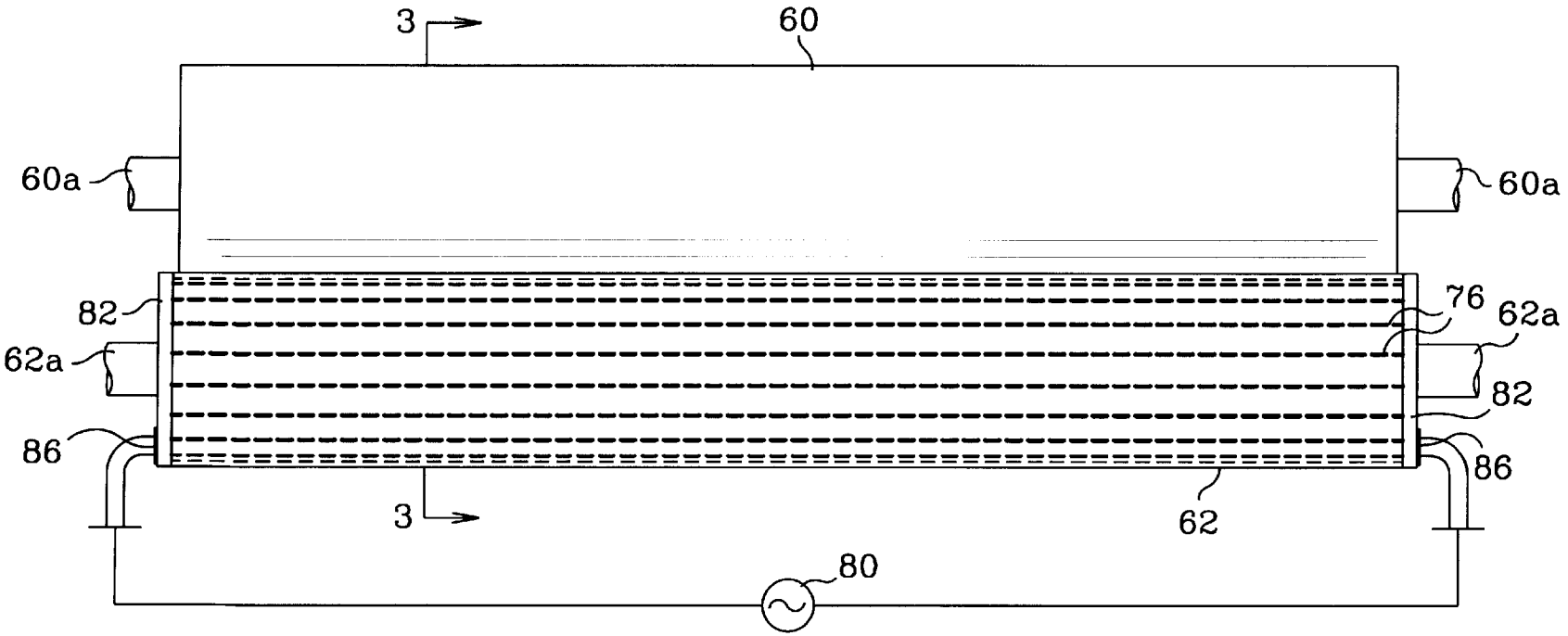
FIG. 2 is a front view of a heated fuser in which heating wires from the heating element in the pressure roller.
Figure 3A:
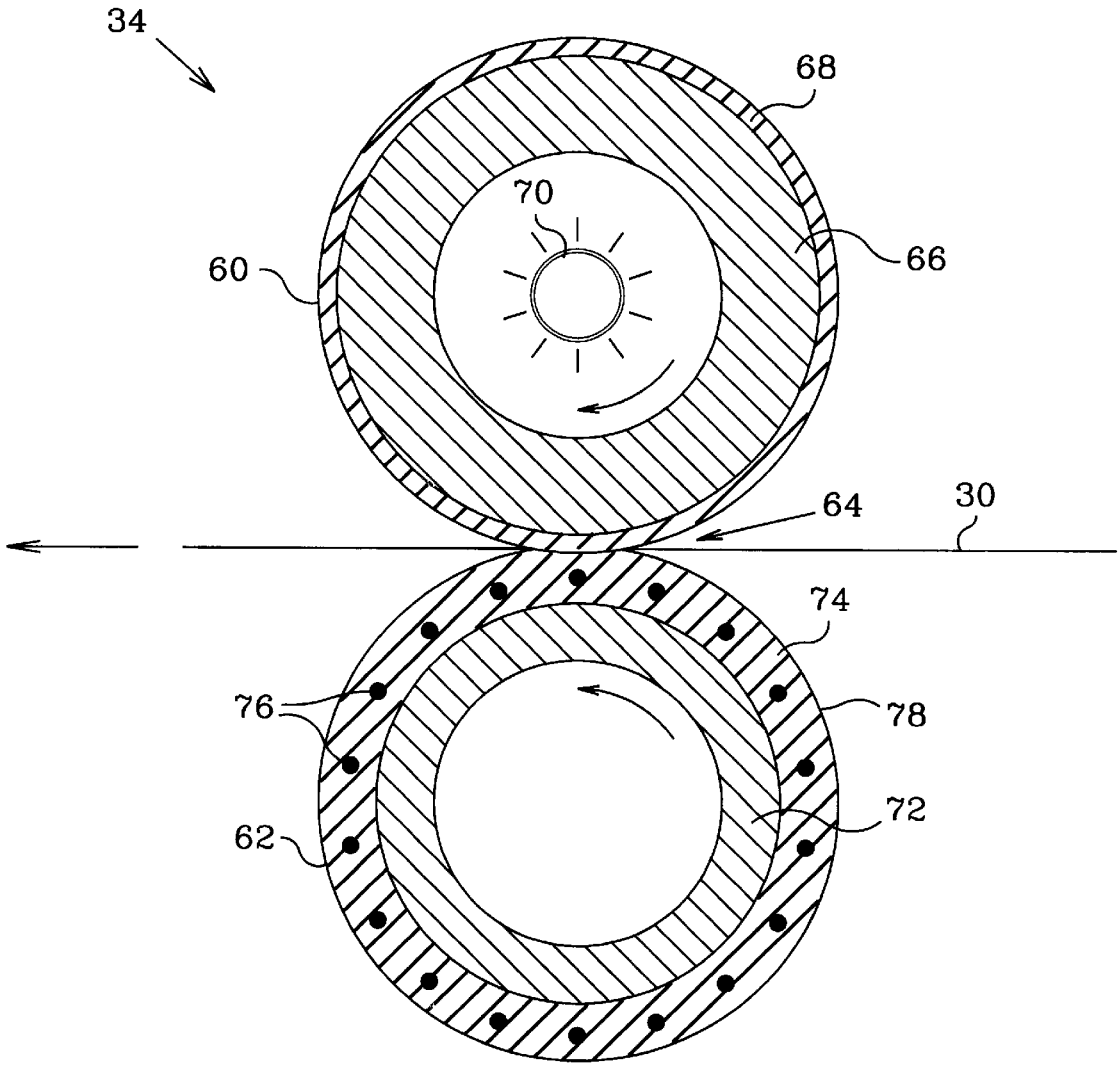
FIG. 3A is a cross section view taken along the line 3—3 in FIG. 2 showing heating wires embedded in the outer layer of the roller.
Figure 3B:
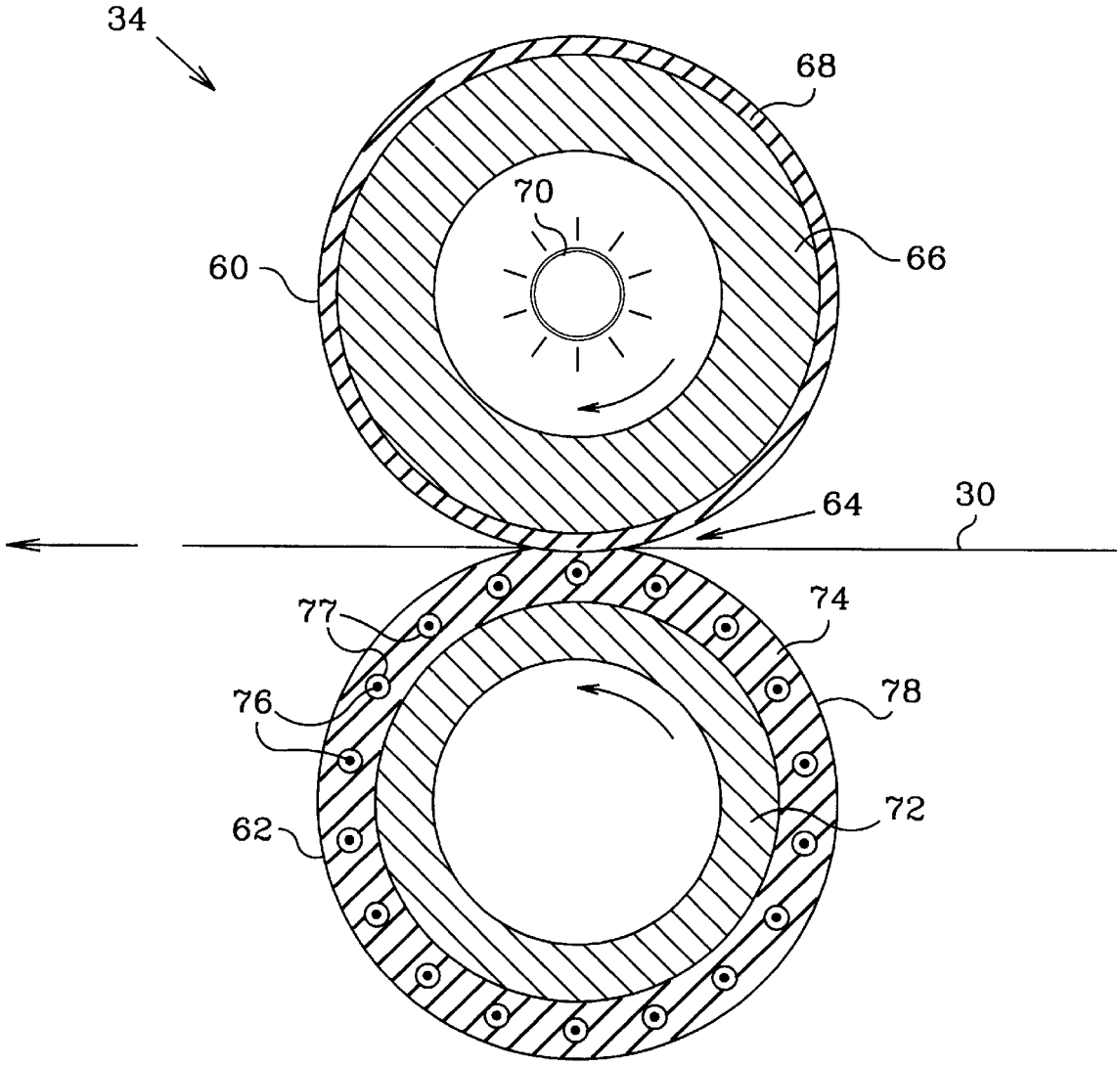
FIG. 3B is a cross section view taken along the line 3—3 in FIG. 2 showing heating wires extending through holes formed in the outer layer of the roller.
Figure 4:
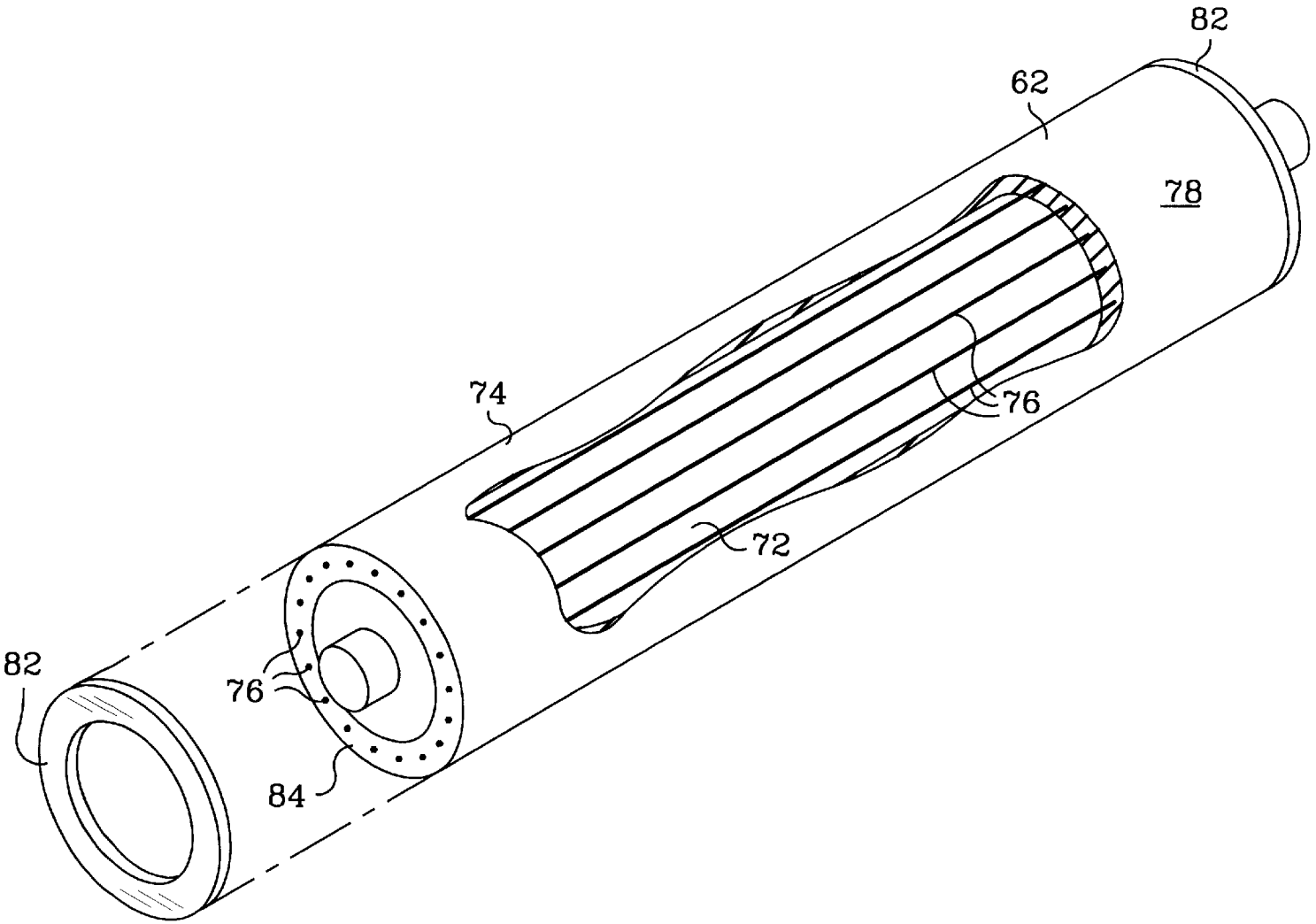
FIG. 4 is a perspective exploded end view and partial cut-away view of one version of the pressure roller shown in FIGS. 2 and 3 in which a solid conductive disk is used as the contact between the heating wires and the voltage source.
Figure 5:
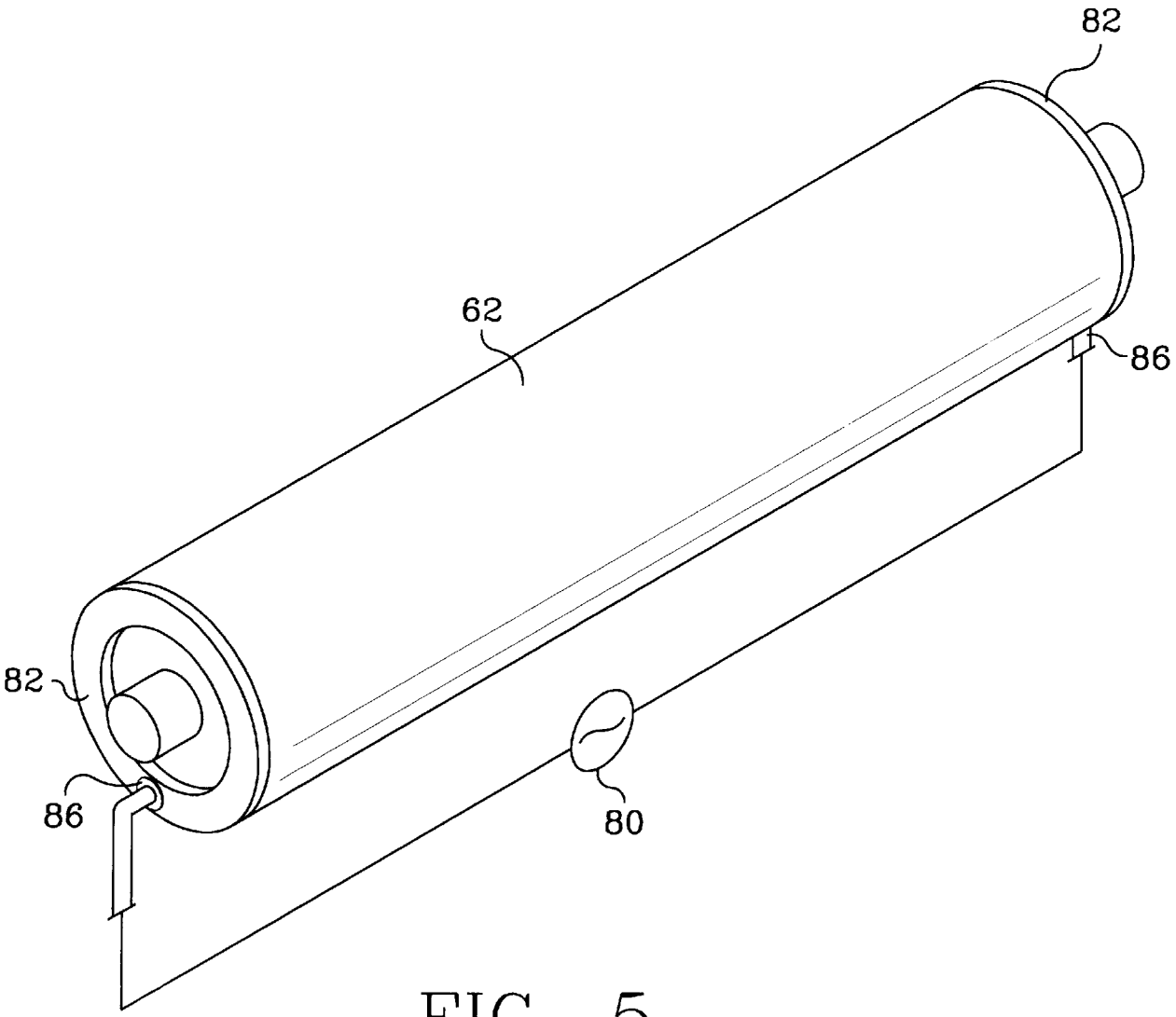
FIG. 5 is an assembled perspective end view of the pressure roller shown in FIG. 4.

Referring now to FIGS. 2 and 3, the shafts 60A and 62A of the fuser rollers 60 and 62 are mounted on bearings (not shown) which are biased to press the fuser rollers 60 and 62 against one another. Fusing roller 60 and pressure roller 62 engage to form a nip 64, which is best seen in FIG. 3. Toner is fused to paper 30 in nip 64. One or both rollers are motor driven to advance paper 30 through nip 64. As shown in FIG. 3, fusing roller 60 is typically constructed with a metal core 66 and an outer layer 68. Outer layer 68 is often made of a hard "release" material such as Teflon®. Core 66 is hollow. A quartz lamp or other suitable heating element 70 is positioned inside core 66 along the length of fusing roller 60. Pressure roller 62 is typically constructed with a metal core 72 and a pliable outer layer 74. Pressure roller 62 may also include a thin Teflon® release layer (not shown).

Referring to FIGS. 2–5, a series of heating wires 76 extend axially along the length of pressure roller 62. Wires 76 are positioned in outer layer 74 of pressure roller 62. Heating wires 76 may extend straight along the length of pressure roller 62 as shown in the drawings, or heating wires 76 may form a helical wrap around and along roller 62 or any other form of axial extension that may be necessary to achieve the desired heating profile for roller 62. Heating wires 76 may be embedded in outer layer 74 as an integrated component as shown in FIG. 3A, or heating wires 76 may be inserted into holes 77 formed axially through outer layer 74 of roller 62 as shown in FIG. 3B. Although wires 76 should be positioned near the surface 78 of pressure roller 62, the actual depth of wires 66 in outer layer 74 will depend on the composition of outer layer 74, the size, number and resistivity of wires 76, the magnitude of the voltage applied to wires 76, and the desired temperature profile at nip 64. For example, it is expected that the application of 220 volts to eighteen 20 gage nickel-chromium wires spaced evenly around the pressure roller at a depth of 2.5 mm in an elastomeric outer layer 74 that is 5 mm thick will be sufficient to heat surface 78 to about 150° C.

Figure 6:
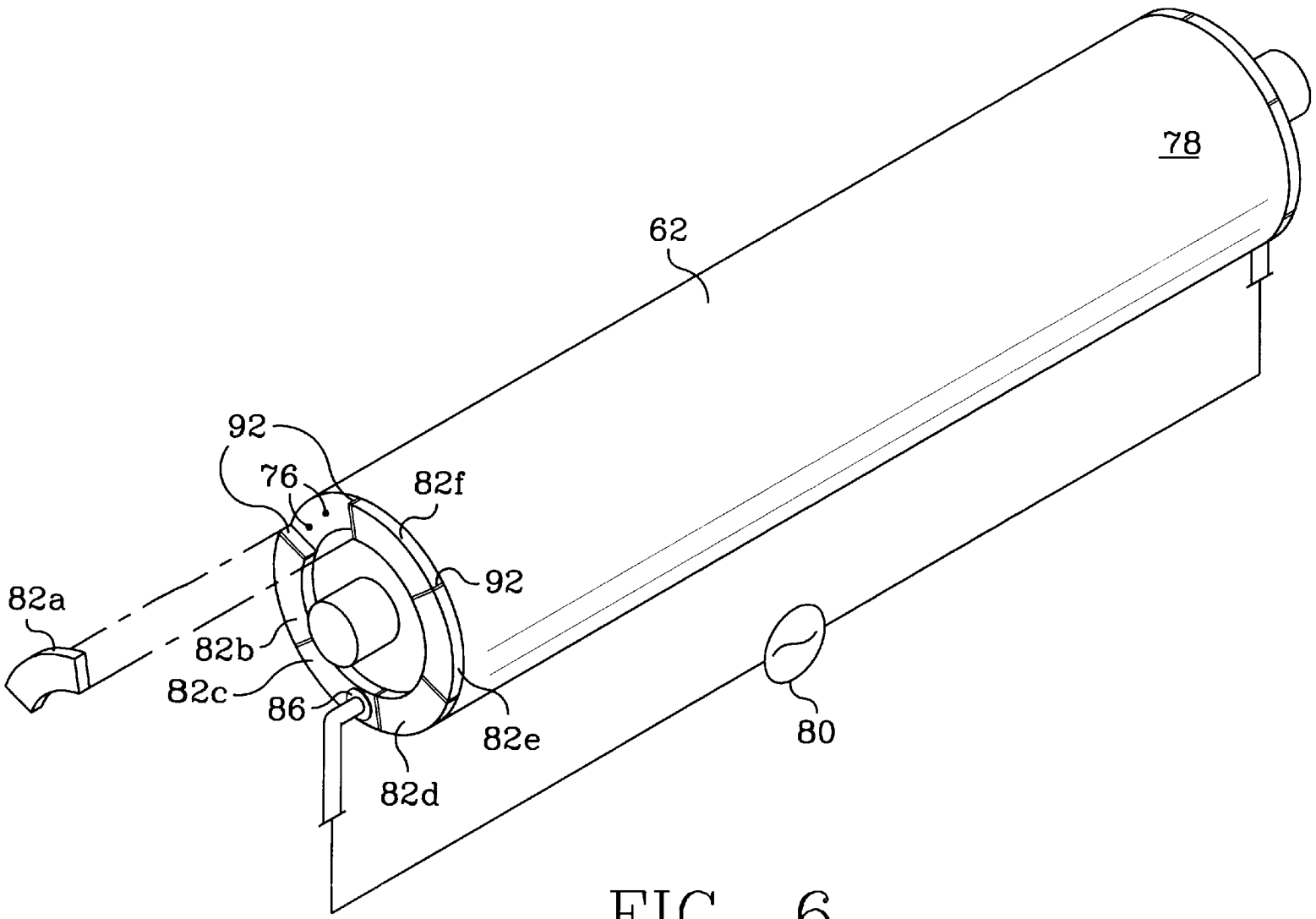
FIG. 6 is an assembled perspective end view of another version of the pressure roller of FIGS. 2 and 3 in which a segmented conductive disk is used as the contact between the heating wires and the source of electrical current.
Figure 7:
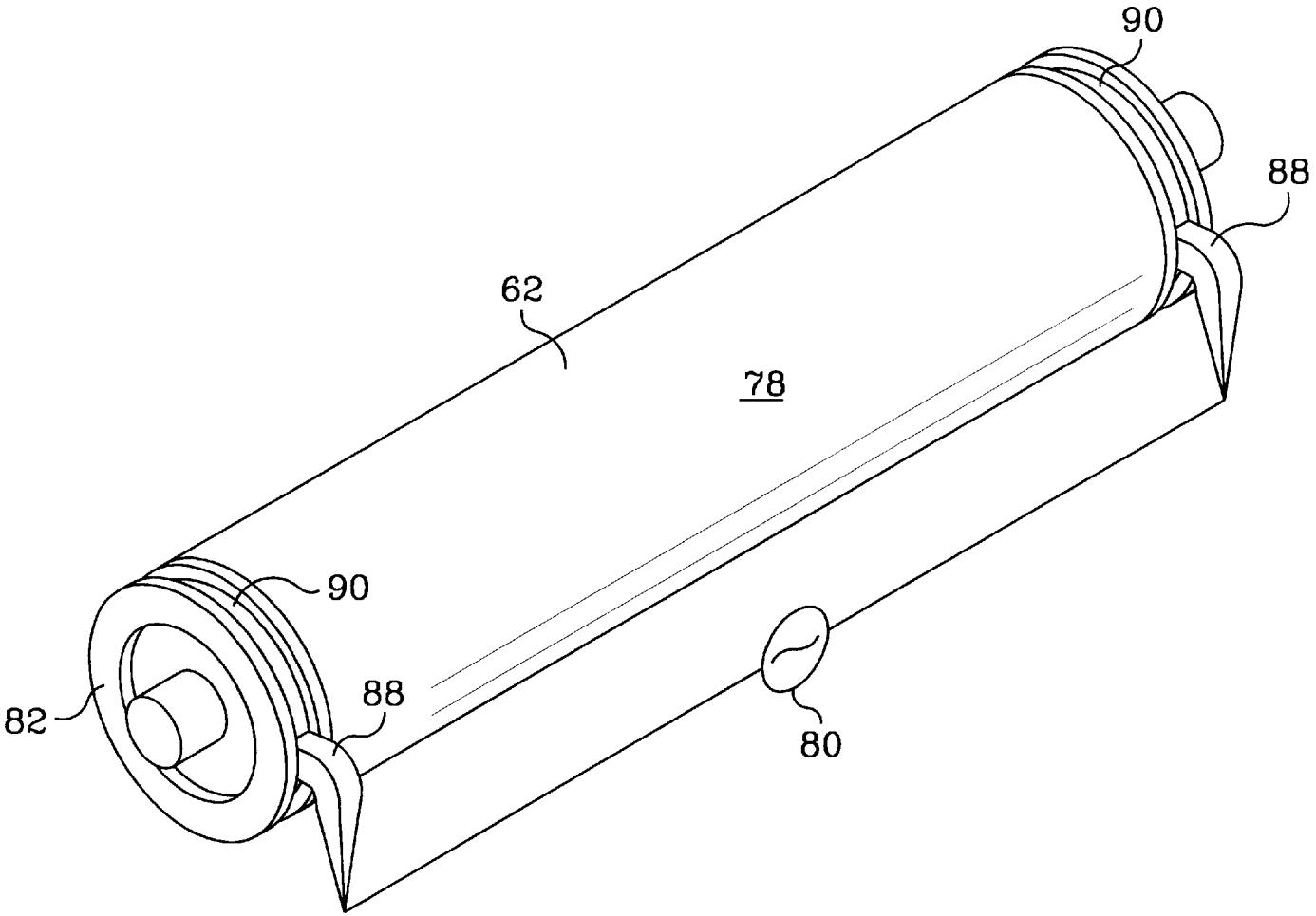
FIG. 7 is an assembled perspective end view of a third version of the pressure roller shown in FIGS. 2 and 3 in which a conductive shoe slides along the disks to maintain the electrical connection between the disks and the power source as the roller rotates.
Figure 8:
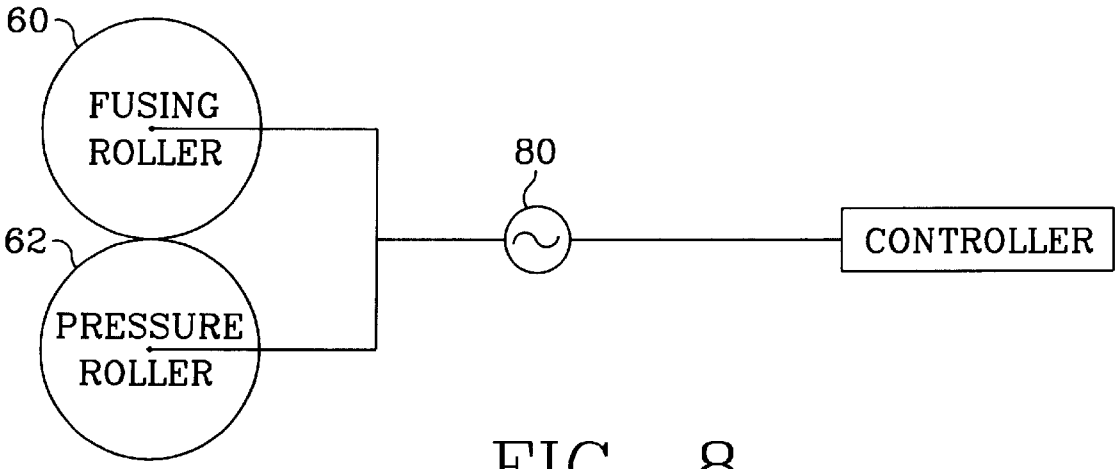
FIG. 8 is a schematic view in which the heating wires in the pressure roller are energized through the same voltage source used to energize the heating element in the fusing roller.
Figure 9:
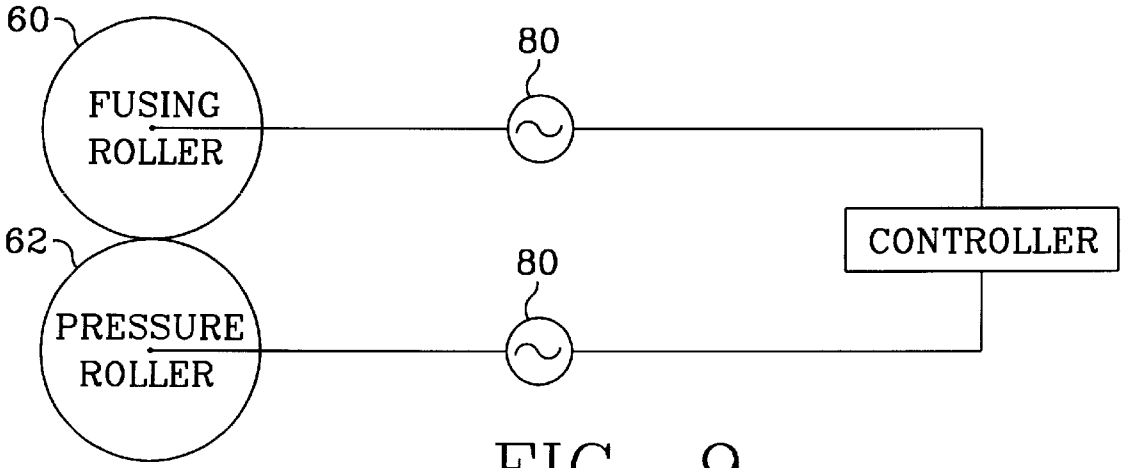
FIG. 9 is a schematic view in which the heating wires in the pressure roller are energized and controlled independent of the heating element in the fusing roller.

Voltage is applied to wires 76 from a power source 80 through conductive disks 82. Conductive disks 82 are attached to the ends 84 of pressure roller 62. Because conductive disks 82 rotate with pressure roller 62, a pair of wipers 86 are used to provide the sliding electrical contact between conductive disks 82 and power source 80. In an alternative embodiment shown in FIG. 7, a conductive shoe 88 rides along a groove 90 in disks 82 to provide the sliding electrical contact between disks 82 and power source 80. Conductive disks 82 may be constructed as a unitary conductive member, as shown in FIGS. 2–5, or as a series of segments 82A–82H insulated from one another by insulating members 92, as shown in FIG. 6. Conductive disks 82 should be constructed as unitary conductive members when it is desirable to energize of all the heating wires 76 at the same time. Conductive disks 82 should be constructed as a series of insulated conductive segments when it is desirable to energize individual heating wires 76 or groups of heating wires 76. Heating wires 76 in pressure roller 62 may be energized through the same voltage source 80 used to energize heating element 70 in fusing roller 60 at the direction of controller 15, as shown in FIG. 8. Or, heating wires 76 can be energized and controlled independent of heating element 70 in the fusing roller 60, as shown in FIG. 9.

Figure 10:
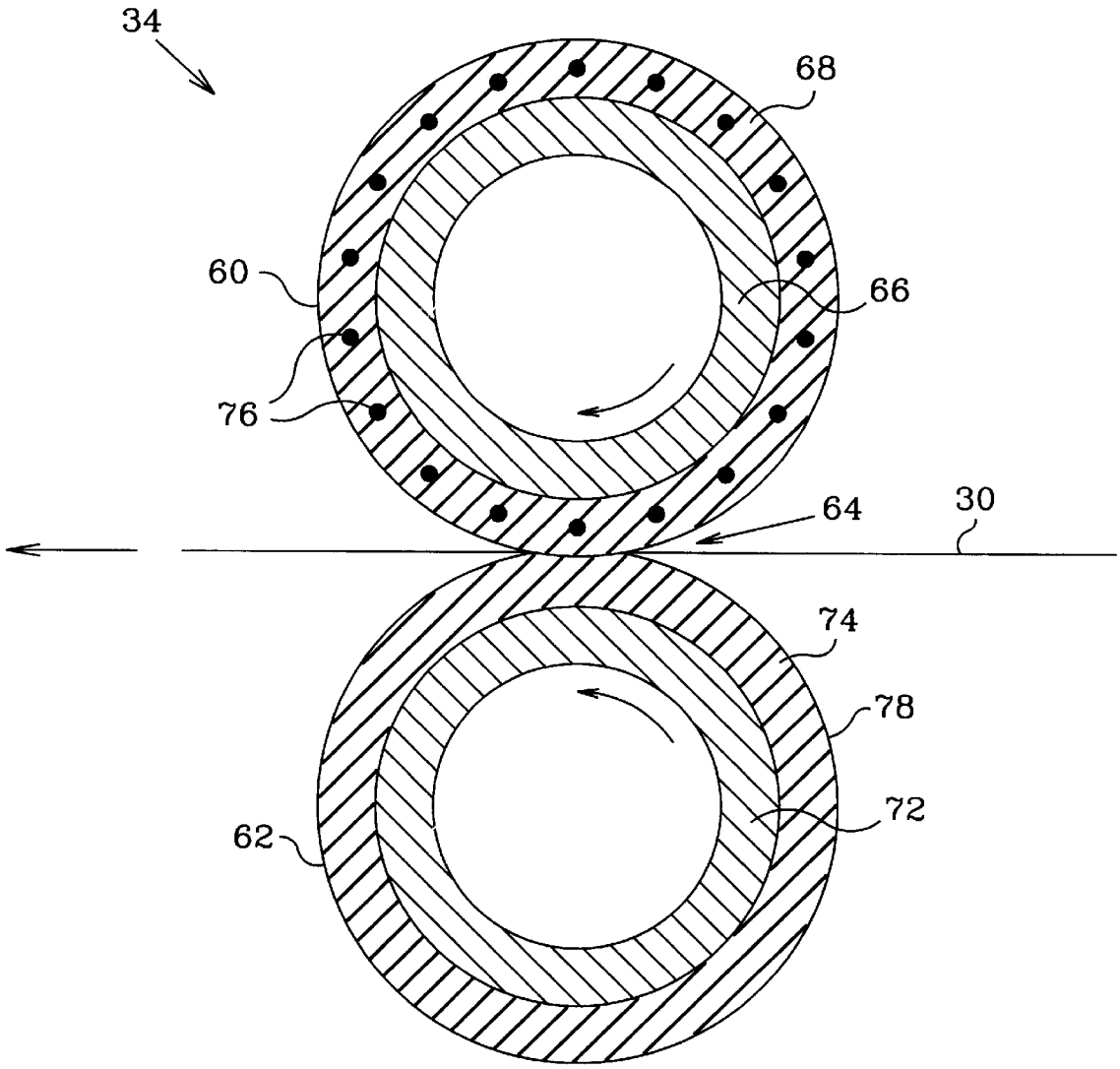
FIG. 10 is a cross section view of an alternative embodiment of the invention in which heating wires form the heating element in the fusing roller.

Although the invention has been shown and described with reference to a pressure roller in a laser printer fuser, the invention may be embodied in other components and printing devices. For example, heating wires 76 may be used to heat fusing roller 60, as shown in FIG. 10, alone or in combination with the heated pressure roller described above. Outer layer 68 of fusing roller 60 is somewhat thicker in this embodiment to accommodate heating wires 76. And, although the outer surface of fusing roller 60 may still receive a coating of Teflon®, it is expected that outer layer 68 will be made of a hard rubber compound. The heated fuser roller of this invention is also suitable for use in all types of laser printers, copiers, facsimile machines and the variety of other electrophotographic printing devices that use a heated roller fuser. Therefore, it is to be understood that the invention may be embodied in other forms and details without departing from the spirit and scope of the invention as defined in the following claims.

What is claimed is:

1. A fuser roller, comprising:

an elongated roller having pliable material;

a plurality of individually distinct heating wires extending axially through the pliable material; and a disk disposed at one end of the roller, the disk having a plurality of conductive segments insulated from one another, each conductive segment electrically connected to one or more of the wires.

2. A fuser roller according to claim 1, further comprising a conductive wiper contacting the conductive segments.

* * * * *